US007878492B2

(12) United States Patent
Dykstra

(10) Patent No.: US 7,878,492 B2
(45) Date of Patent: Feb. 1, 2011

(54) T-SLOT CLAMP

(75) Inventor: Henry Dykstra, Lenox, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 101 days.

(21) Appl. No.: 11/803,526

(22) Filed: May 15, 2007

(65) Prior Publication Data

US 2007/0267799 A1 Nov. 22, 2007

Related U.S. Application Data

(60) Provisional application No. 60/801,793, filed on May 18, 2006.

(51) Int. Cl.

| | |
|---|---|
| ***B25B 1/14*** | (2006.01) |
| ***B25B 5/12*** | (2006.01) |
| ***B25B 1/02*** | (2006.01) |
| ***B25B 5/02*** | (2006.01) |
| ***B25B 1/00*** | (2006.01) |
| ***B43L 5/00*** | (2006.01) |

(52) U.S. Cl. ..... 269/228; 269/89; 269/201

(58) Field of Classification Search ..... 269/228, 269/89, 201

See application file for complete search history.

(56) References Cited

U.S. PATENT DOCUMENTS

| | | | | |
|---|---|---|---|---|
| 2,386,567 | A * | 10/1945 | Olson | 269/228 |
| 2,600,584 | A * | 6/1952 | Snell | 269/135 |
| 2,726,693 | A * | 12/1955 | Saxton | 269/157 |
| 2,988,122 | A * | 6/1961 | Stevens et al. | 269/221 |
| 4,141,543 | A * | 2/1979 | Kato | 269/228 |
| 6,893,012 | B2 * | 5/2005 | Wong | 269/249 |
| 2007/0102859 | A1 * | 5/2007 | Hagan et al. | 269/228 |

* cited by examiner

*Primary Examiner*—Joseph J Hail, III
*Assistant Examiner*—Jamal Daniel
(74) *Attorney, Agent, or Firm*—Harness, Dickey & Pierce, P.L.C.

(57) ABSTRACT

A T-slot clamp including a base and a bar member pivotally connected to the base. A link pivotally connected to the bar member. A handle pivotally connected to the link, wherein the handle is rotatable about an axis of the handle.

23 Claims, 6 Drawing Sheets

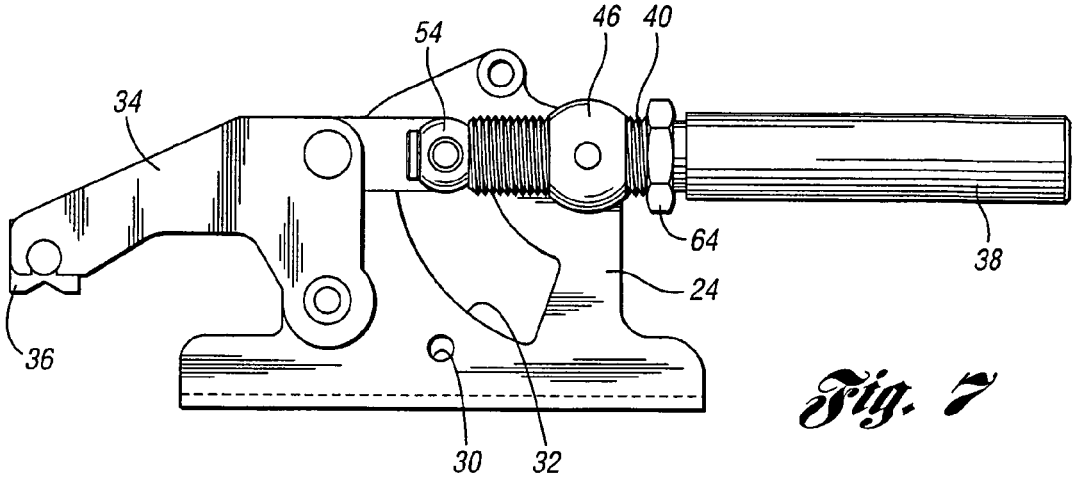
Fig. 7
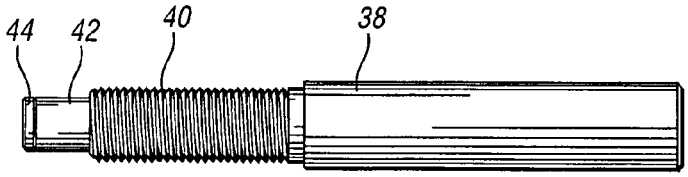
Fig. 8
Fig. 9
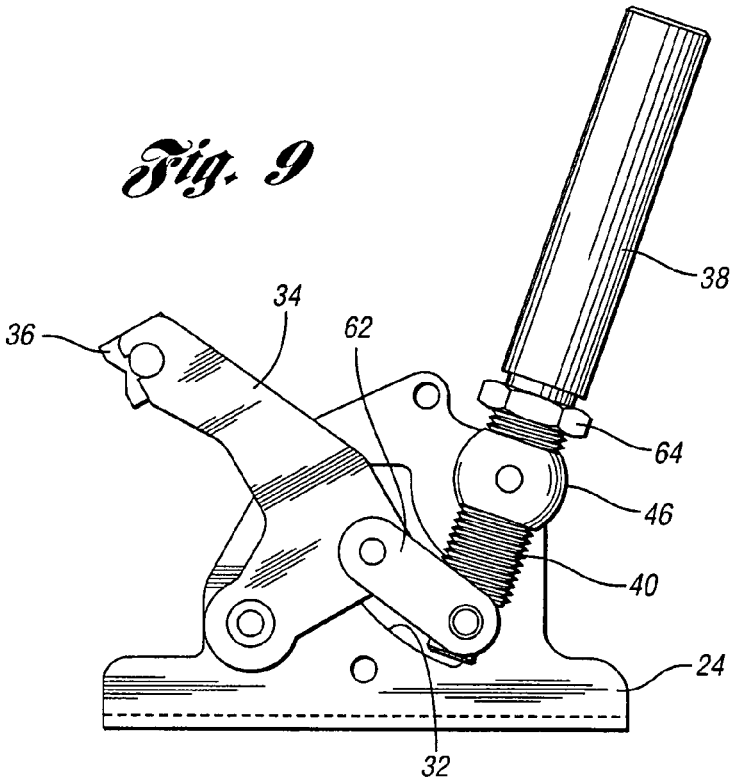

T-SLOT CLAMP

This application claims the benefit of provisional application 60/801,793 filed May 18, 2006

BACKGROUND OF THE INVENTION

This invention broadly relates to clamps. More particularly, this invention relates to a T-slot hold down clamp that is adjustable to various positions in its fully closed or clamped position.

Toggle and hold down clamps have been used and known in the art for many years. The typical hold down or toggle clamp includes a clamping arm which pivots between a released and clamped position. Many of these prior art clamps are used to hold work pieces in place for processing, for clamping two objects to one another, or for clamping an object to a work table or other work surface. Some of these prior art hold down clamps are a variety known as a T-slot clamp, wherein the clamp is arranged within a T-slot arranged on a work surface or work table. The T-slot clamp is held in place within the T-slot via a bolt or other fastener and is capable of sliding along the T-slot within the table to a predetermined position to hold a work piece during operations thereon. These T-slot clamps are capable of being arranged in a variety of positions with relation to the work piece and within the work table having the T-slots arranged therein. The prior art hold down clamps generally are quickly engageable and disengageable to the work piece or object being held. They also provide a considerable holding and clamping force which enables them to hold the work piece or objects securely during operations thereon.

Many of these prior art hold down clamps hold the clamped position through a variety of means, these means include maintaining the force applied to the bar or arm of the clamp. Other prior art clamps use a releasable assembly for a clamp. Further, prior art clamps create a holding force by passing the links of the toggle clamps into an over center position, the over center position subjects the links and the pivot points of the clamp to very high loads resulting in increased wear and potential deformation of the clamp components thereby reducing the life of the clamp. Many of these prior art clamps also are designed to create their toggle or over center force at one predetermined position with relation to the object being held thus precipitating the need for numerous clamps if the objects being held have varying heights and widths onto which the clamp is being engaged. There have been problems with prior art clamps releasing due to vibration and other unforeseen forces during the operations being performed on the work pieces which are held by the clamp. There also have been problems with the prior art clamps in maintaining a predetermined hold down force needed to keep the objects being held at a precise position such that operations can be performed to predetermined specifications.

Therefore, there is a need in the art for an improved T-slot clamp that is more robust, has greater strength and interchangeability than prior art clamps. There also is a need in the art for an improved T-slot clamp that is capable of being adjusted to a variety of heights in its fully clamped or toggled position to allow for one clamp to perform multiple operations on a variety of sized components being held via the T-slot clamp. There also is a need in the art for a T-slot clamp that is capable of one handed operation including one handed adjustment of the bar member. There also is the need in the art for an improved T-slot clamp that is capable of being locked in its fully closed or clamped position.

SUMMARY OF THE INVENTION

One object of the present invention may be to provide an improved T-slot clamp.

Another object of the present invention may be to provide a more robust T-slot clamp.

Still another object of the present invention may be to provide a T-slot clamp that is capable of adjusting a bar member height to a variety of different size work objects or components being held in the fully clamped or closed position.

Yet a further object of the present invention may be to provide a T-slot clamp that has better interchangeability which improves assembly and manufacturing of the clamps.

Still another object of the present invention may be to provide a T-slot clamp that is capable of one handed adjustment.

Still a further object of the present invention may be to provide a T-slot clamp that uses a release lever to lock the clamp in its fully clamped position.

Still another object of the present invention may be to provide a T-slot clamp that has a toggle point that is located on an accurate and repeatable edge.

Still a further object of the present invention may be to provide a T-slot clamp that is capable of being used on a variety of T-slot work surfaces or work tables.

According to the present invention, the foregoing and other objects and advantages are obtained by a novel design for an improved T-slot clamp. The T-slot clamp includes a base having a first and second side bracket. A handle is pivotally connected to the side brackets. One end of the handle is pivotally connected to a link. The opposite end of the link is pivotally connected to a bar member. The bar member is pivotally connected to the side brackets near one end of the bar member. The pivot connection between the link and handle is arranged within a slot in the side bracket of the base. The slot generally has a partial circular quadrant shape, however any other known shape can be used for the slot in the side brackets. The handle will be capable of rotation along its axis thus allowing for an adjustability of the end of the bar member with relation to the objects being held thereon. The width of the slot in the side bracket will determine the amount of adjustability capable at the end of the bar member with relation to the work piece being held. The T-slot clamp may include a release lever that is capable of locking in the clamp in its fully closed or clamped position.

Other objects, features and advantages of the present invention will become apparent from the subsequent description and the appended claims, taken in conjunction with the accompanying drawings.

BRIEF DESCRIPTION OF THE DRAWINGS

FIG. 7 shows a side view of a T-slot clamp according to the present invention with a side bracket and one link removed for clarity.

FIG. 8 shows a side view of a handle according to the present invention.

FIG. 9 shows a side view of the T-slot clamp in a fully open position with a side bracket removed for clarity.

DESCRIPTION OF THE EMBODIMENT(S)

Figure 16:
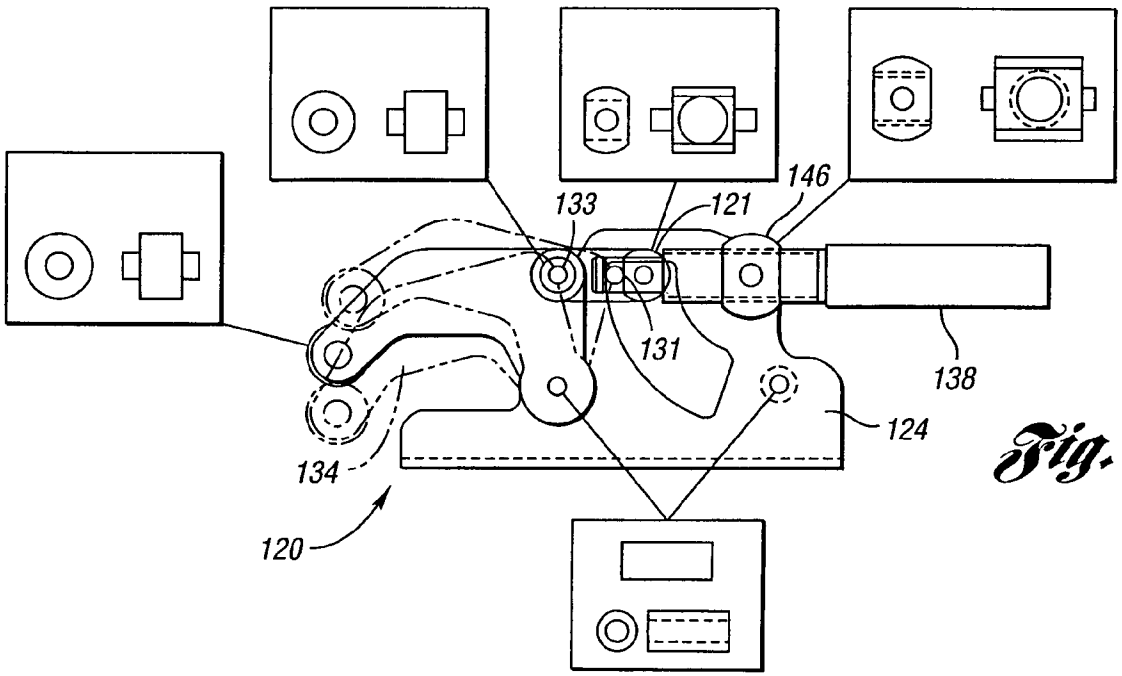
FIG. 16 shows a side view of an alternate embodiment of a T-slot clamp according to the present invention.
Figure 17:
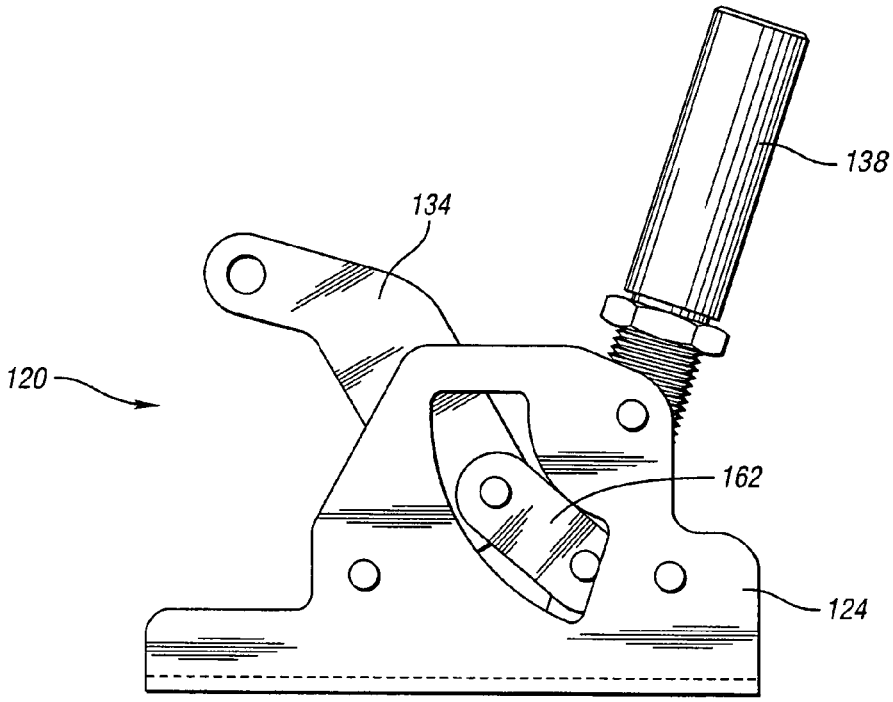
FIG. 17 shows the alternate embodiment of the present invention in its fully open position.
Figure 18:
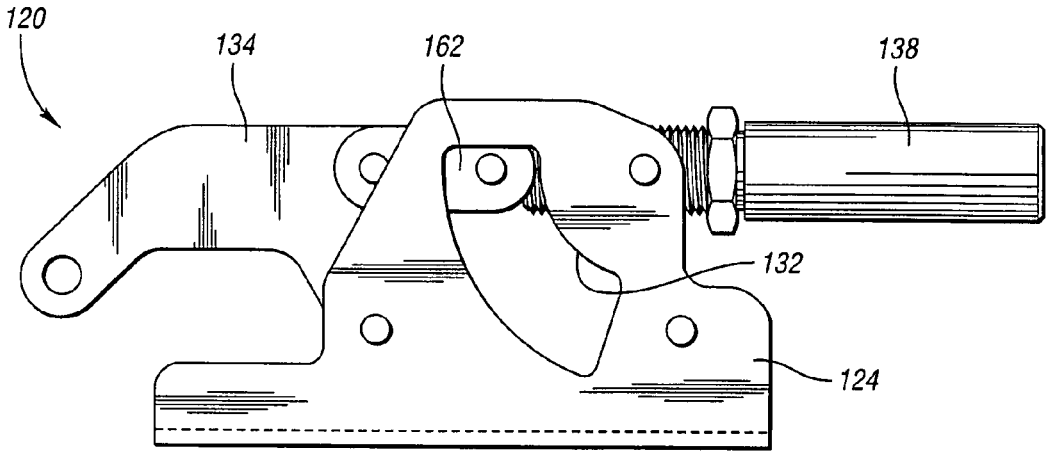
FIG. 18 shows the alternate embodiment of the T-slot clamp in its fully closed position.

Referring to the drawings, FIGS. 1 through 15 show an embodiment of a T-slot clamp 20 according to the present invention. It should be noted that the T-slot clamp 20 shown in the drawings is a toggle action locking clamp, however, it may be used in the form of a wedge lock clamp action system and any other known clamping system. It should be noted that the above-identified T-slot clamp 20 is for use in industrial applications with a T-slot table, work surface or other device. However, the clamp 20 can be used in any known push pull clamp, hold down clamp, squeeze clamp, or any other known power or manual clamp or the like used in industrial applications or any other known applications. The present invention may also be used in conjunction with or modified to be used with electronic clamps, hydraulic clamps, or any other known clamp and clamping mechanism. The T-slot clamp 20 according to the present invention generally uses a toggle action to lock the T-slot clamp 20 into its fully closed or clamped position. The toggle or over center point is reached via the movement of the handle with relation to the link and bar member. It should be noted that FIGS. 1 through 15 show one embodiment of the T-slot clamp 20 according to the present invention while FIGS. 16 through 18 show another embodiment of the T-slot clamp 20 according to the present invention. However, there are also many other contemplated designs and embodiments for the T-slot clamp 20 according to the present invention. The T-slot clamp 20 as shown may be configured with different size and shape components and may be configured in a different clamping environment than those shown in the drawings. The T-slot clamp 20 according to the present invention is ideally suited for use with a T-slot work surface or work table and is capable of holding work pieces, work components or parts with the required force needed to allow for industrial operations to take place on the part or pieces being held by the T-slot clamp 20 according to the present invention. It should be noted that all of the parts described hereafter are generally made of a steel material, however any other known metal, composite, plastic, ceramic, natural material or the like may be used for any of the components described thereafter.

FIGS. 1 through 15 show one embodiment of a T-slot clamp 20 according to the present invention. The T-slot clamp 20 includes a base 22. The base 22 generally includes a first and second side bracket 24 arranged in contact with one another. The side brackets 24 are generally aligned side by side with one another and are in contact with one another at a bottom flange 26 thereof. The bottom flange 26 includes a semi circular notch 28 arranged at predetermined positions on the surface thereof. The first and second side bracket 24 will be arranged and in contact with one another at the bottom flanges 26 thereof such that the semi circular notches 28 will oppose one another and create a circular orifice through the combined bottom flanges 26 of the first and second side brackets 24. The upright portions of the side brackets 24 will have a plurality of orifices 30 therethrough wherein the orifices 30 are generally of a circular shape. However, it should be noted that any other shape can be used for the orifices 30. Any other shape can be used for the notch in the bottom flange of the side brackets also. The side bracket 24 also includes a predetermined shaped slot 32 through an upright portion thereof. In the embodiment shown the slot 32 generally has a partial circular quadrant shape, however any other known shape may be used for the slot 32. The ends of the slot 32 generally have a flat surface and the two flat surfaces are connected by curved surfaces that have a predetermined curvature. The width of the slot 32 will determine the adjustability of the bar member 34 and part contact 36 with that of the part, device or work piece being held by the T-slot clamp 20. It should be noted that any other known shape can be used for the side bracket 24 depending on the design requirements and environment the T-slot clamp 20 will be used in. The circular orifices formed in the bottom flange 26 by the combination of the first and second side brackets 24 will be used to allow a bolt or any other known type of fastener to be arranged in such orifice and allow for the T-slot clamp 20 to be slid into a T-slot on a work table or work surface upon which the clamp 20 will be used. It is contemplated to use a fastener or bolt through just one of the orifices or through both of the orifices depending on the required angle necessary to hold the work piece in its predetermined position on the work table or work surface. It should be noted that the slot 32 as described above has a predetermined shape but that any other known shape may be used for the slot 32 depending on the design requirements and the amount of adjustability the T-slot clamp 20 needs at the end of the bar member 34. The top flat surface of the slot 32 generally will define the toggle point or over center position for the clamp 20 and allow the clamp 20 to be placed into its fully clamped or closed position. The flat surface of the slot 32 will allow for an accurate and repeatable edge for the toggle point of the T-slot clamp 20. It is also contemplated to have the first and second side brackets 24 connected via a weld or any other known fastening technique, chemical bonding, mechanical bonding, or the like to create a permanent connection between the side brackets 24 to form a rigid and solid base 22. However, it is also contemplated to have the side brackets 24 arranged next to one another and held together via fasteners arranged through orifices 30 in the upright portion of the side brackets 24 or fasteners through the bottom flange 26. It should be noted that it is also contemplated in another embodiment that a single unitary member is formed creating the base 22 having a first and second side bracket extending from a bottom surface. Therefore, any type of base 22 may be used as described above or in other not disclosed contemplated embodiments.

A handle 38 is pivotally connected to the side bracket 24 at a predetermined position thereon. The handle 38 generally has a cylindrical shape. One end of the handle 38 will have a grip for use by the operator of the clamp 20. Another part of the handle 38 will include a threaded portion 40 which extends from one end of the grip. On the end of the handle 38 extending from the threaded portion 40 is a reduced diameter portion 42. The reduced diameter portion 42 will have a circumferential groove 44 in one end thereof for allowing the use of a fastener therein to secure the handle 38 with relation to the base 22. A handle rotator member 46 generally has a cylindrical shape with a circular orifice 48 through a mid point thereof. The circular orifice 48 is threaded to match that of the threads on the handle 38. Extending from one side of the handle rotator member 46 is a first extension 50. The first extension 50 extends a predetermined distance. Extending from the opposite end is a second extension 52 that extends a predetermined distance wherein the second extension 52 may or may not have a predetermined threaded portion therein. The first extension 50 is placed through one of the orifices 30 of the side bracket 24 of the T-slot clamp 20 then the second extension 52 is placed through a similar orifice 30 in the other side bracket 24 of the T-slot clamp 20. This will create a rotatable and fixed pivotal connection for the handle 38 with relation to the base 22. The handle rotator member 46 may be arranged anywhere along the threaded portion 40 of the handle 38. The handle 38 will rotate with respect to the handle rotator member 46 along the axis of the handle 38. The handle rotator member 46 rotates with respect to the base 22 and will allow for rotation of the handle 38 with respect to the base 22.

Arranged on the reduced diameter portion 42 of the handle 38 is a link connector 54. The link connector 54 generally will have a first extension 56 extending from a side thereof and a second extension 58 extending from the other side. An orifice 60 is arranged at a mid point through a diameter thereof. The diameter of the orifice 60 will be slightly larger than that of the diameter of the reduced diameter portion 42 of the handle 38. The link connector 54 will slide over the reduced diameter portion 42 of the handle 38 and be secured to the handle 38 via any known fastener arranged within the circumferential groove 44 on the end of the reduced diameter portion 42 of the handle 38. The link connector 54 will be arranged through an orifice of a link 62 and then the slot 32 of the side bracket 24. This will allow for the end of the handle 38 via the link connector 54 to slide within the slot 32 of the side brackets 24 and allow for movement of the clamp 20 between a fully opened and fully closed position. The handle 38 also may have a fastener such as a locking nut 64 arranged on the threaded portion 40 thereof which will allow for the handle 38 to be locked with relation to the handle rotator member 46 thus creating a fixed toggle and fully clamped position for the end of the T-slot clamp 20 at the bar member 34. When this nut 64 is in contact with the handle rotator member 46 it will stop rotation of the handle 38 with respect to handle rotator member 46 along the axis of the handle 38. Therefore, the handle 38 is pivotally connected at a fixed point to the base 22 via the handle rotator member 46 and is pivotally arranged within the slot 32 of the base 22 via the link connector 54. The handle 38 is arranged between the first and second side bracket upright members thus providing some protection from weld slag and other environmental contaminates in the clamping environment.

A first and second link 62 generally have an oval shape. It should be noted that any known shape can be used for the links 62. The links 62 are pivotally connected to the link connector 54 on one end thereof and to the bar member 34 on the opposite end thereof. The first and second links 62 generally have a first and second orifice 66 which are generally of a circular shape, however any other known shape can be used for the orifices 66. One of the orifices 66 generally is larger than the other orifice 66. The larger orifice 66 is used to connect the link 62 to the link connector 54 and hence end of the handle 38 of the T-slot clamp 20. The smaller orifice 66 is used to connect to the bar member 34 on the opposite end thereof. Any known rivet, fastener, pole, dowel, pin, screw, or the like is used to make the pivotal connection between the link 62 and the bar member 34. The link connector 54 will slide within the slot 32 in the base 22 between the fully opened and unclamped position and the fully clamped or closed position for the T-slot clamp 20 according to the present invention. The first and second links 62 are arranged between an outer surface of the link connector 54 and/or handle 38 and an inner surface of the side brackets 24 of the base 22 of the T-slot clamp 20. It should be noted that any known bushing or spacer 68 may be used and arranged around the fastener used to connect the link 62 to the bar member 34. The fastener used to pivotally connect the link 62 to the bar member 34 will be arranged through the orifice of any such spacer or bearing member 68.

A bar member 34 will be pivotally connected to one end of the link 62 as described above and will be pivotally connected to the side brackets 24 of the base 22 at a fixed point. The pivotal connection with the base 22 may be located at or near a bottom or mid portion of the side brackets 24. Any known fastener will be used to connect the bar members 34 to the side brackets 24. It is also contemplated to use a spacer arranged between the side brackets 24 and the first and second bar member 34 pivotally connected to the base 22 at the fixed point. The bar members 34 generally have a flat and straight longitudinal edge such that no bends or offsets occur on the bar 34. The bar member 34 includes a plurality of orifices 70 therethrough with one located near both ends thereof and one located at another predetermined location. One of the end orifices 70 is arranged such that it is generally circular in shape and forms a generally circular notch at an edge thereof. Arranged within this circular notch/orifice 70 is a part contact member 36. The part contact member 36 will include an extension 72 extending from each side thereof and a predetermined shaped contact face. In the embodiment shown a generally triangular cross sectional contact face is used. However, any other shape part contact member 36 may be used with the T-slot clamp 20 according to the present invention. The first and second bar members 34 may or may not contact an inner surface of the links 62 with a spacer arranged between the bar members 34. The part contact member 36 is arranged between inner surfaces of the bar members 34. The bar members 34 will be capable of a rotation with respect to the base 22 via the fixed pivot point. The part contact member 36 also will be capable of an adjustability in a vertical direction with relation to the work surface or work table upon which the T-slot clamp 20 is mounted. When the handle 38 is rotated along its axis this will allow for the handle 38 to be moved in a linear direction with relation to the handle rotator member 46 thus allowing for the end of the handle 38 to be moved in a linear direction within the slot 32. This linear movement of the end of the handle 38 will move the link 62 in a linear direction which in turn will apply a linear force upon the bar member 34 which will force rotation of the bar member 34 about the fixed pivot point on the base 22 thus allowing for the end of the bar member 34 to move in a vertical direction either upward or downward with relation to the work surface or table upon which a work piece will be clamped. The direction of the movement of the end of the bar member 34 may not be exactly vertical but generally may move in a vertical direction with a predetermined horizontal component built in due to the fixed pivot point of the bar member 34 at one end thereof. This will allow for an adjustability of the clamp 20 with respect to the work piece being held thus reducing the number of clamps needed to securely fasten a variety of different size work pieces with relation to the work surface or table. It is contemplated to have anywhere from a few hundredths of an inch up to multiple inches of adjustability in the end of the bar member 34 when it is in its fully clamped or closed position. This adjustability will be determined upon the width of the slot 32 through the upright portions of the side brackets 24. The wider the slot 32 the more adjustability there will be for the bar member 34 with relation to the work piece being clamped.

A release lever 72 may be arranged on an outside surface of one of the side brackets 24 of the base 22. It should be noted that the release lever 72 may be arranged on either side depending on if the operator is right handed or left handed. The release lever 72 generally will have a predetermined shape and will be pivotally connected to the outer surface of the T-slot clamp 20 via extensions of the handle rotator member 46 and/or link connector 54. The release lever 72 will have a plurality of predetermined shaped slots or orifices 74 therethrough. The slots 74 will be used to connect to the base 22 via the handle rotator member 46 and/or the link connector 54. A spring 76 may be arranged between an extension of the handle rotator member 46 and an orifice 74 on the release lever 72. The spring 76 will urge the release lever 72 into its locked or home position. When the clamp 20 is in its fully clamped or closed position a lock surface 78 will engage with a fastener, screw, dowel, pin, or the like 80 extending from a surface of the side bracket 24. When the user of the clamp 20 wants to put the clamp into its fully open or unclamped position, the user will provide the necessary force to the release lever 72 and thus urge the release lever 72 toward the handle 38 of the clamp 20. This will disengage the lock surface 78 from the locking fastener 80 on the base 22 thus allowing for the clamp 20 to be open into its fully open position. When the release lever 72 is released by the operator of the clamp 20, the spring 76 will urge the release lever 72 back to its home position. The slots 74 will allow for the release lever 72 to move in conjunction with the handle 38 of the T-slot clamp 20 during movement from the fully opened position to the multiple fully closed or clamped positions available. It should be noted that other types of locking levers or release levers are also contemplated to be used on the T-slot clamp 20 according to the present invention. It is also contemplated to use the T-slot clamp 20 without any release lever or locking lever such as that shown in FIGS. 16 through 18.

Figure 1:
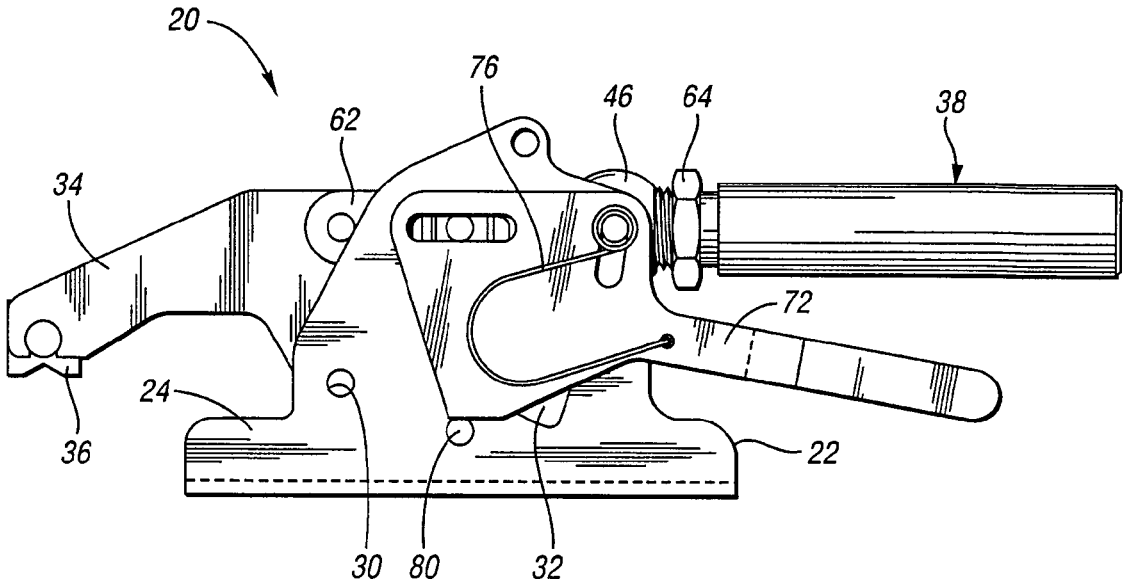
FIG. 1 shows a side view of a T-slot clamp in the closed position according to the present invention.
Figure 2:
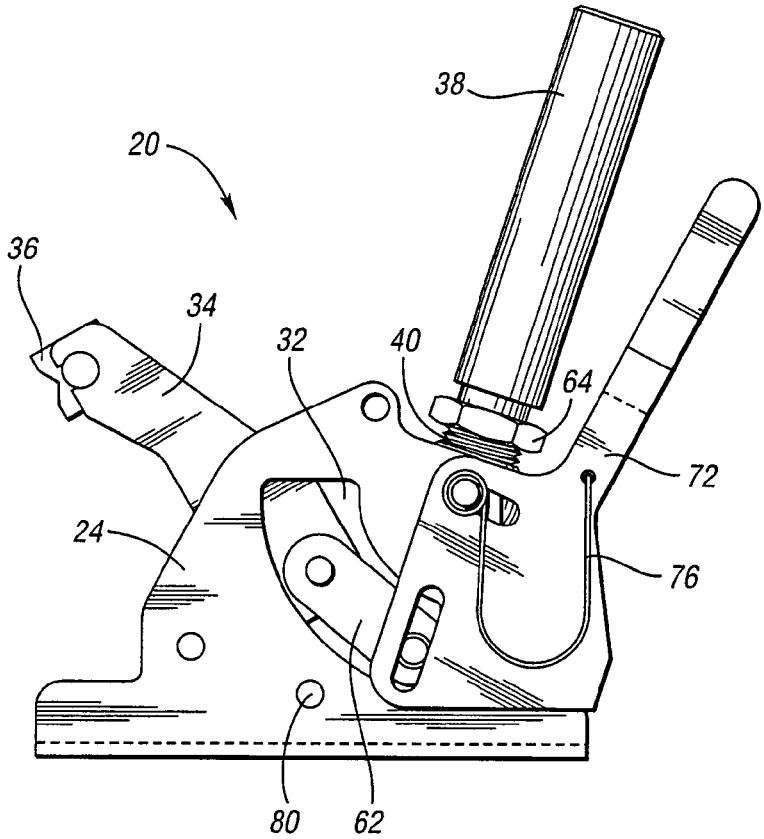
FIG. 2 shows a side view of a T-slot clamp in its open or fully unclamped position according to the present invention.
Figure 3:
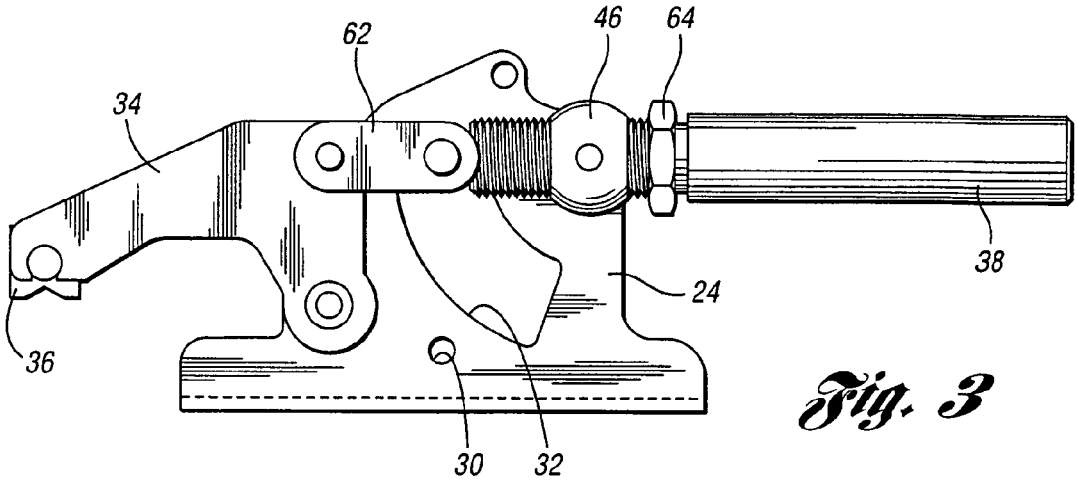
FIG. 3 shows a side view of a T-slot clamp according to the present invention with one of the side brackets removed for clarity.
Figure 4:
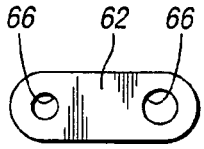
FIG. 4 shows a side view of a link according to the present invention.
Figure 5:
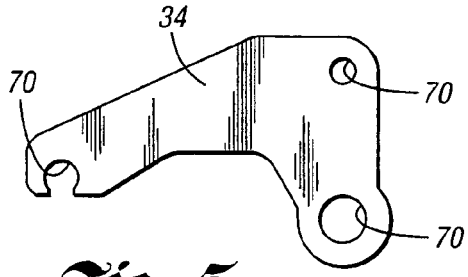
FIG. 5 shows a side view of a bar member according to the present invention.
Figure 6:
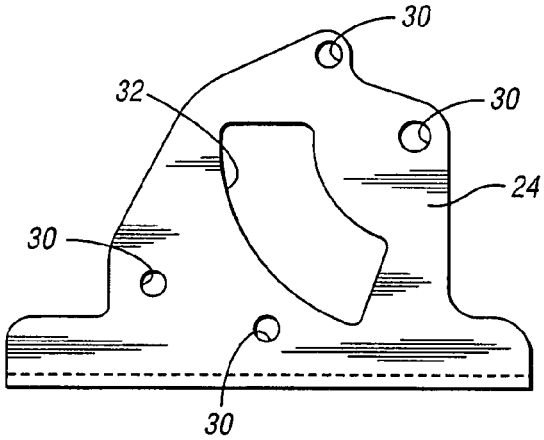
FIG. 6 shows a side view of a side bracket according to the present invention.
Figure 10:
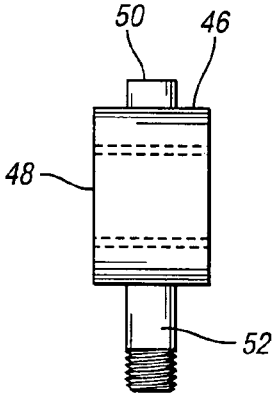
FIG. 10 shows a side view of a handle rotator member according to the present invention.
Figure 11:
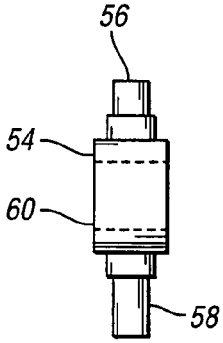
FIG. 11 shows a side view of a link connector according to the present invention.
Figure 12:
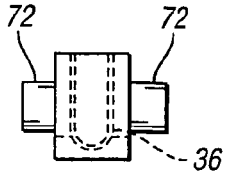
FIG. 12 shows a side view of a part contact member according to the present invention.
Figure 13:
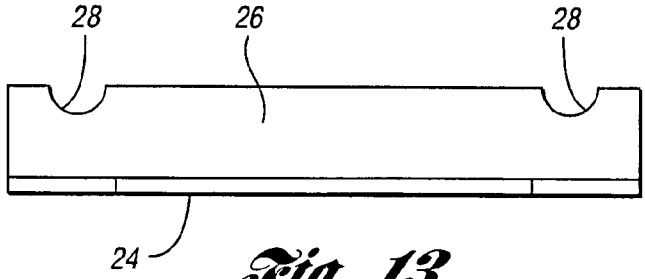
FIG. 13 shows a top view of a side bracket according to the present invention.
Figure 14:
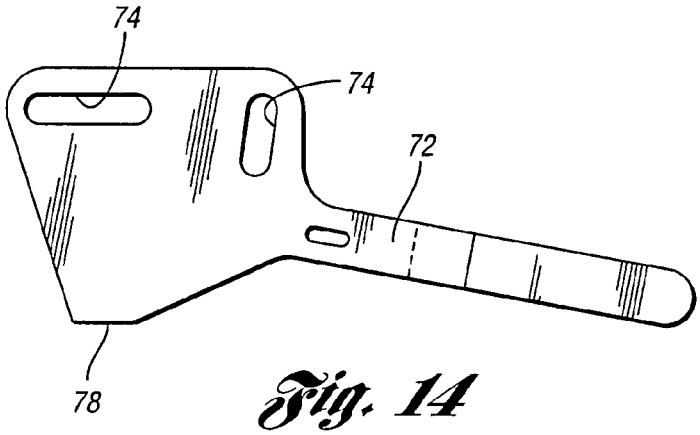
FIG. 14 shows a side view of a release lever according to the present invention.
Figure 15:
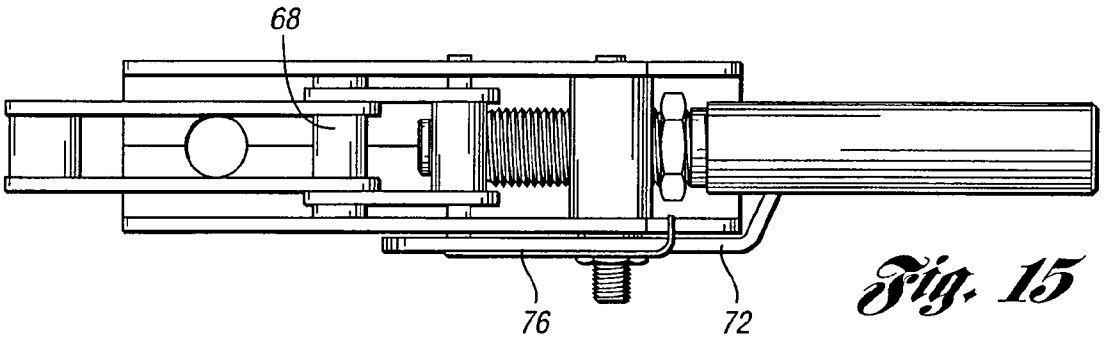
FIG. 15 shows a top view of a T-slot clamp according to the present invention.

In operation, the clamp 20 is in its open or unclamped position when the handle 38 is pulled fully open and is generally in a vertical position with relation to the base 22. The handle 38 is designed such that the handle 38 has a predetermined angle from the base 22 such that there is appropriate clearance for the hands and fingers of the clamp operator. When the operator of the clamp 20 wants to secure a work piece with the T-slot clamp 20, the operator will put the clamp 20 into its fully closed position thus achieving the over center position between the handle 38, the link 62 and bar member 34. The toggle point is created between the extension of the handle rotator member 46, the extension of the link connector 54 and the fastener securing the link 62 to the bar member 34. The toggle point will occur on the end of the slot 32 arranged within the side brackets 24 of the base 22. The toggle point will occur between a portion of the link connector and a surface of the slots 32. FIG. 1 shows the clamp 20 in its fully toggled or clamped position with the extension of the link connector 54 in contact with the toggle surface of the slot 32. FIG. 1 also shows the release lever 72 contacting the locking fastener 80 of the side brackets 24 of the base 22. If any adjustment is needed with relation to the end of the bar member 34 and hence part contact member 36 and the part or work piece being held, the operator of the clamp 20 will rotate the handle 38 along its axis, thus moving the part contact member 36 in a generally vertical direction with relation to the work surface or work table upon which the clamp 20 is arranged. Once the part contact member 36 is properly positioned with relation to the part being held the operator of the clamp will stop rotation of the handle 38 and place the T-slot clamp 20 into its toggle position. The nut 64 arranged over the threaded portion 40 of the handle 38 can be used to lock the T-slot clamp 20 into a predetermined position with relation to the part contact member 36 when the clamp 20 is in its fully clamped or closed position. This locking nut 64 will stop rotation of the handle 38 with relation to the handle rotator member 46 and hence base 22 of the T-slot clamp 20.

FIGS. 16 through 18 show an alternate embodiment of the T-slot clamp 120 according to the present invention. Like numerals indicate like parts. The alternate embodiment T-slot clamp 120 generally uses many of the same parts as the embodiment described above. However, the T-slot clamp 120 according to FIGS. 16 through 18 does not include a release lever or locking lever. Furthermore, the handle 138 of the clamp 120 according to the alternate embodiment of the invention includes a handle rotator member 146 arranged over the threaded portion 140. The handle 138 includes a handle pin 121 arranged over the reduced diameter portion 142 of the handle 138. The handle 138 also includes a circular orifice 131 through a diameter thereof wherein a fastener, pin, dowel, pull pin, or any other fastener is arranged therein and provides a fastening mechanism to secure the handle pin 121 onto the end of the reduced diameter portion 142 of the handle 138. The end of the bar member 134 also includes a circular orifice 170 through a surface thereof and not along an edge like that as shown above in the first embodiment. It should be noted that the part contact member 136 also includes a smooth surface that will contact the part being held. However, it should be noted that for either embodiment a square, serrated, toothed, or smooth surface may be used to contact the part depending on the design requirements for the clamp and clamping environment. The clamp in FIGS. 16 through 18 works in the same manner as that described above including the adjustability as shown in FIG. 16. The clamp 120 does not have a locking lever, however the clamp 120 stays in its fully clamped or closed position due to the toggle force created by the clamp 120. The toggle creates a high force that is capable of keeping the clamp in its fully clamped position even during vibrations, jolts, and other forces in the clamping environment. It should also be noted that an arm connect pin 133 may be used to pivotally connect the link 162 to the bar member 134 in the alternate embodiment. The arm connect pin 133 has a predetermined cylindrical shape portion with an extension extending from each side thereof. The extensions will be placed through an orifice of the link 162 and bar members 134 with the predetermined sized cylindrical portion arranged between the inner surfaces of the first and second bar members 134. The extensions of the arm connect pin 133 will thus extend through the surfaces of the bar members 134 and links 162, but allow for movement of the bar members 134 and links 162 within and out of the gap between the first and second side brackets 124.

It should be noted that the use of an over center toggle T-slot clamp 20 provides a more reliable over center point thus increasing the strength and durability of the clamp 20 during operations on the assembly lines in the industry in which the clamp 20 may be used. The T-slot clamp 20 is capable of a variety of holding forces with a more repeatable clamped or closed position at a variety of locations because of the adjustability of the bar member 34 via rotation of the handle 38. Therefore, one clamp 20 according to the present invention can be used to replace several prior art clamps needed to operate on an industrial manufacturing line that perform operations on a variety of different size work pieces.

The present invention has been described in an illustrative manner. It is to be understood that the terminology which has been used is intended to be in the nature of words of description rather than of limitation.

Any modifications and variations of the present invention are possible in light of the above teachings. Therefore, the present invention may be practiced otherwise than as specifically described.

What is claimed is:

1. A T-slot clamp, said clamp including:

a base;

a bar member pivotally connected to said base;

a link pivotally connected to said bar member; and;

a handle pivotally connected to said link and said base, a handle rotator member pivotally coupled with said base such that said handle rotator member rotates with respect to the base, said handle rotatably coupled with said handle rotator member for enabling said handle to rotate with respect to said base such that a connection point of said handle and link moves in a slot in the base, and said handle is rotatable about an axis of the handle enabling said handle to move axially through said handle rotator member for adjusting said bar member.

2. The clamp of claim 1 wherein said rotating of said handle about said axis moves said bar member with relation to a workpiece or surface the clamp is used on.

3. The clamp of claim 1 wherein said base having a predetermined shape slot therein, said slot will define a range of movement of said bar member by said rotation of said handle.

4. The clamp of claim 3 wherein said predetermined shape slot is generally a partial circular quadrant shape.

5. The clamp of claim 1 wherein said handle having a threaded portion.

6. The clamp of claim 5 wherein said handle rotator member arranged on said threaded portion of said handle.

7. The clamp of claim 6 wherein said handle rotator member is arranged in an orifice of said base.

8. The clamp of claim 1 further including a link connector arranged over an end of said handle.

9. The clamp of claim 8 wherein said link connector is arranged through an orifice of said link and extends into a slot of said base.

10. The clamp of claim 1 further including a release lever arranged on said base.

11. The clamp of claim 10 further including a lock member extending from a surface of said base, said release lever engages said lock member when the clamp is in a closed position.

12. The clamp of claim 1 further including a second link and a second bar member.

13. The clamp of claim 5 further including a threaded member arranged on said threaded portion of said handle, said threaded member capable of locking said bar member in a predetermined position with relation to a workpiece.

14. The clamp of claim 1 further including a part contact member arranged on or near an end of said bar member.

15. A manual toggle action clamp for use in a T-slot, said clamp including a base;

a bar member pivotally connected to said base;

a link pivotally connected to said bar member;

a link connector pivotally connected to said link;

a handle rotator member pivotally connected to said base such that said handle rotator member rotates with respect to the base, a handle rotatably coupled with said handle rotator member for enabling said handle to rotate with respect to said base such that the link connector moves in a slot in the base; and a handle connected to said link connector and said handle rotator member, said handle moving through said handle rotator member for adjusting height of said bar member with respect to said base.

16. The clamp of claim 15 wherein said handle having a predetermined length threaded portion and a reduced diameter portion on one end thereof.

17. The clamp of claim 16 wherein said handle having a grip member arranged over an end thereof.

18. The clamp of claim 15 wherein said base having a slot through a surface thereof, said link connector arranged and moveable within said slot.

19. The clamp of claim 15 further including a release lever arranged on a surface of said base, said release lever locks the clamp in a closed or clamped position.

20. The clamp of claim 16 wherein said handle rotates along an axis thereof and with respect to said handle rotator member and said link connector.

21. The clamp of claim 15 further including a part contact member arranged on said bar member.

22. The clamp of claim 15 further including a second bar member and a second link.

23. The clamp of claim 15 wherein said base having a first and second side member and a bottom member.

* * * * *